US005087206A

United States Patent [19]

Jaenke et al.

[11] Patent Number: 5,087,206

[45] Date of Patent: Feb. 11, 1992

[54] LOW IMPEDANCE CONNECTOR

[75] Inventors: Paul E. Jaenke, Arnold; Joseph R. Cerniglia, Annapolis, both of Md.

[73] Assignee: Westinghouse Electric Corp., Pittsburgh, Pa.

[21] Appl. No.: 618,870

[22] Filed: Nov. 28, 1990

[51] Int. Cl.[5] ..... H01R 4/66

[52] U.S. Cl. ..... 439/92; 439/433; 439/804

[58] Field of Search ..... 439/92, 95, 100, 431, 439/433, 434, 801, 804, 811; 174/556, 6, 7, 51, 78

[56] References Cited

U.S. PATENT DOCUMENTS 2,603,596 7/1952 Vangsnes ..... 439/431 X
3,772,179 11/1973 Beer ..... 439/431 X
4,090,029 5/1978 Lundeberg ..... 174/51
4,181,396 1/1980 Olashaw ..... 439/801

*Primary Examiner*—Eugene F. Desmond
*Attorney, Agent, or Firm*—D. Schron

[57] ABSTRACT

An electrical ground connection having two members, one of which may be connected to a system ground and the other of which may be for a connection to an electrical apparatus to be grounded. Each member includes a circular cavity which faces the cavity of the other member when the two are assembled together. An electrically conducting insert in the form of a multi-faceted rod is provided for insertion into the cavities, and wherein the rod has a slightly greater lateral dimension than that of the cavities, so that when the members are clamped together, the rod will be shaved, thereby exposing bare metal for better electrical contact and reduced resistance.

6 Claims, 3 Drawing Sheets

LOW IMPEDANCE CONNECTOR

BACKGROUND OF THE INVENTION

1. Field of the Invention

The invention in general relates to electrical connectors, and in particular to a low impedance connector which may be used as a low impedance ground in harsh atmospheric environments as well as in the underwater field.

2. Background Information

In order to meet repairability, maintainability and minimum downtime requirements, many complex electrical systems include components of a modular nature to facilitate removal and replacement. Very often, the various components of the system are carried by a metallic support structure and to reduce or eliminate electrical noise, it is desired that the various modules of the system have a common system ground such as the metal support structure itself.

Various types of grounding schemes are utilized including the mounting of metallic housings directly to the metallic support structure to establish a bare metal-to-metal contact. Depending upon the environment in which the equipment is used, such grounding arrangement may prove less than satisfactory, particularly in an under water environment, and further, where dissimilar metals exposed to the sea water are used.

Other grounding arrangements include the use of jacketed ground cables connected to grounding pins on two units to be grounded and for the under water environment, an oil compensated barrier in the form of an oil-filled tube is provided around the grounding strip. Such arrangements provide satisfactory grounding, however, they are undesirable for systems which require component removal for repair and/or maintenance.

The present invention provides for a low impedance connection which may be used as an electrical grounding arrangement in which the making and breaking of the electrical ground connection is relatively simple and an extremely low impedance path to ground is provided.

SUMMARY OF THE INVENTION

The low impedance electrical connector includes first and second electrically conducting members, at least one of which is for electrical connection to electrical equipment. A clamping means is provided for releasably maintaining the members in intimate contact when in use and each member includes a cavity which faces the cavity of the other member when the members are clamped together.

A metallic grounding device such as a multifaceted rod is provided for placement within one of the cavities and is of a softer material than the electrically conducting members. The rod and the cavities are of such dimensions that when the rod is inserted into one of the cavities and the members are clamped together, the rod will align with both cavities, and the surface of the rod will be shaved as the conducting members are brought together so as to make intimate electrical contact with and between the conducting members.

When utilized in harsh environments, a sealing means is provided which surrounds a cavity to exclude the surrounding ambient medium and in the under water medium, the sealing means may take the form of an O-ring.

BRIEF DESCRIPTION OF THE DRAWINGS

In the accompanying drawings, which are not to scale.

DESCRIPTION OF THE PREFERRED EMBODIMENT

Figure 1:
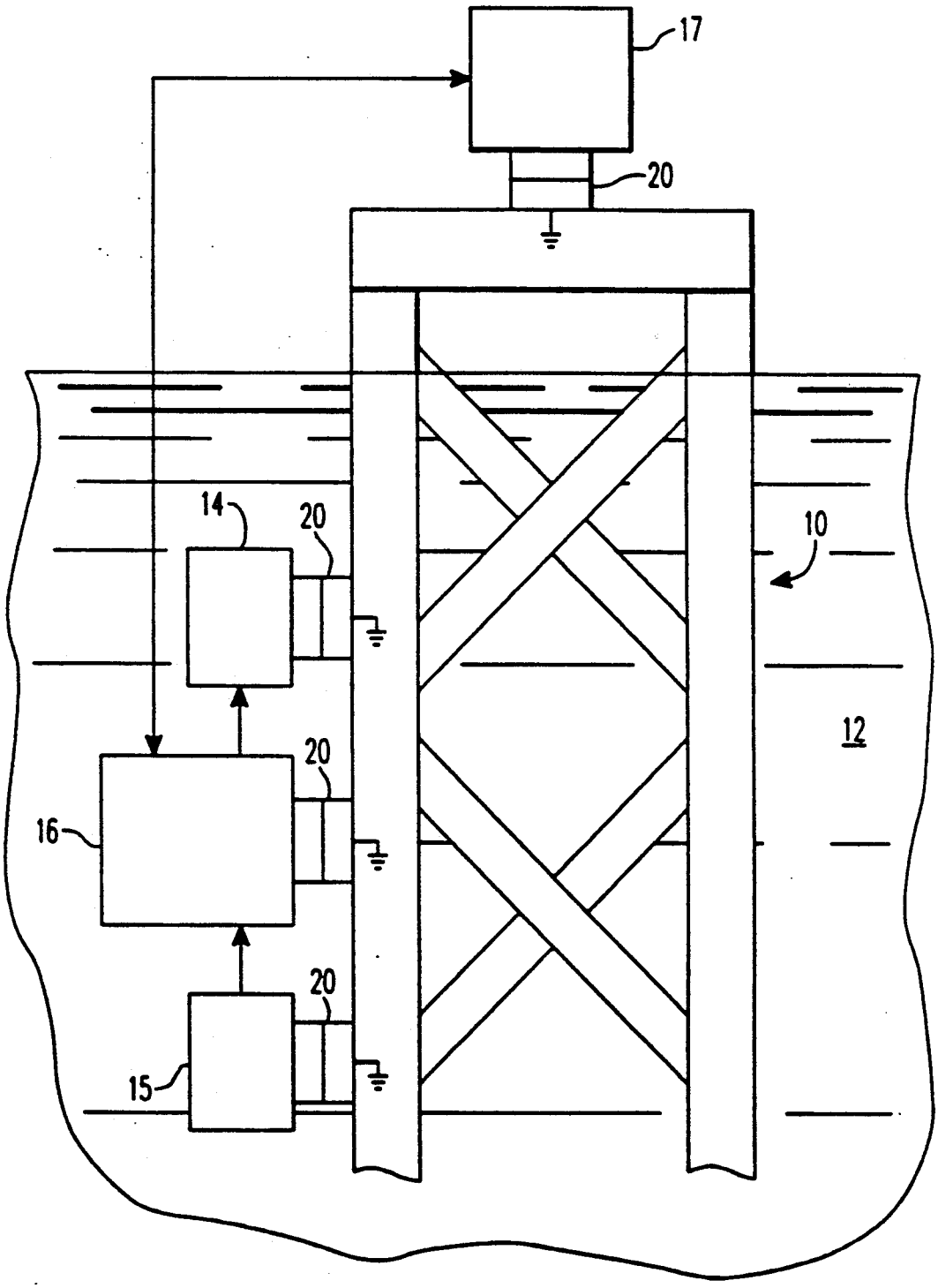
FIG. 1 illustrates a typical environment in which the low impedance connector apparatus of the present invention may be utilized.

Referring now to FIG. 1, there is illustrated, by way of example, an environment in which the present invention may be utilized. A metallic support structure 10 extends into a sea water environment 12 and carries electrical equipment such as sensors 14 and 15 in electrical communication with electronic circuitry 16. The electronic circuitry 16 itself is in electrical communication with a control unit 17 which may be located on the support structure 10 outside of the water environment.

The metallic support structure 10 serves as a common system electrical ground for all the modules of the electrical equipment and to this end each module 14 to 17 includes an electrical ground device 20 in accordance with the present invention.

Figure 2:
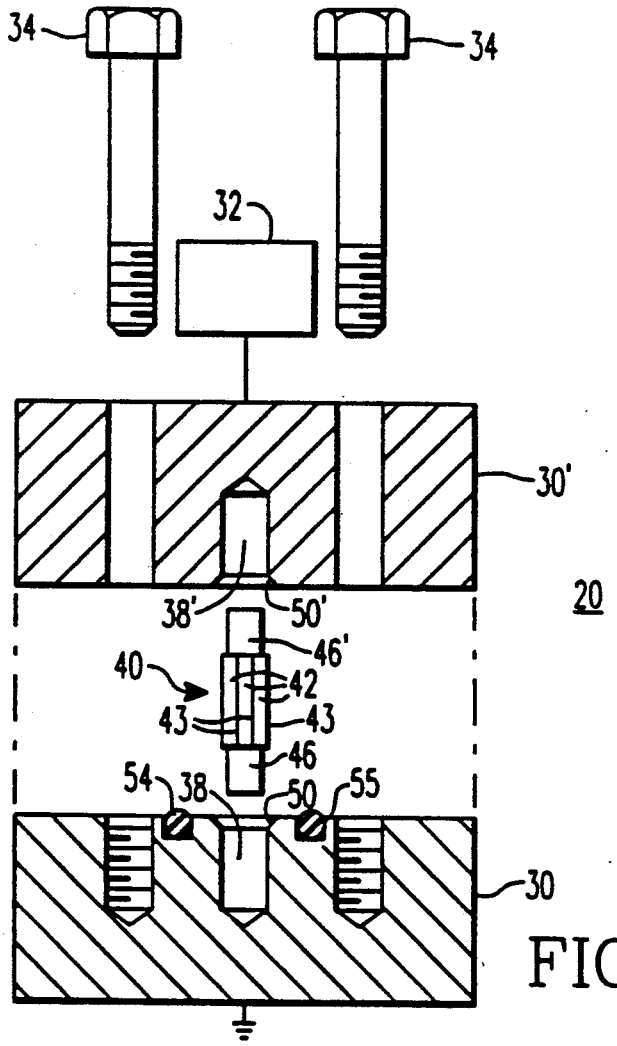
FIG. 2 is an exploded view in cross-section of one embodiment of the present invention.

As illustrated in FIG. 2, the low impedance connector which functions as an electrical grounding device 20 includes first and second electrically conducting members 30 and 30' of a relatively hard metal such as aluminum, stainless steel or titanium, with member 30 being part of a system ground and member 30' being connected to electrical apparatus 32 which must be electrically grounded to the system ground.

Clamping means such as bolts 34 may be used to secure the two members 30 and 30' into intimate contact and disconnection may be simply accomplished with the removal of the bolts 34.

Each of the members 30 and 30' includes a respective cavity 38 and 38' which faces the cavity of the other member when they are clamped together. In a preferred embodiment, each cavity is circular and has a diameter d.

Figure 3:
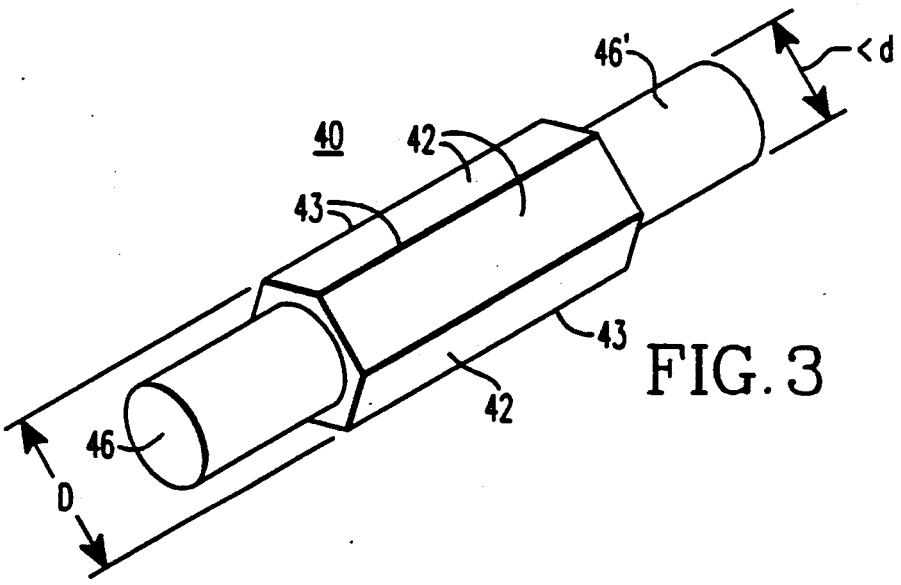
FIG. 3 is a perspective view of one embodiment of an insertable grounding device.

With additional reference to FIG. 3, the assembly further includes a grounding member in the form of an insert 40 of a relatively soft metal such as gold, beryllium copper or copper. The insert is in the form of a rod having a plurality of facets 42, with adjacent facets forming edge portions 43. The maximum lateral dimension of the rod is D, where this dimension D is slightly larger than the diameter d of the cavities 38, 39'.

In order that the rod may be easily inserted into the cavity prior to clamping members 30, 30' together, the end portions 46, 46' of the rod are turned down so as to have a lateral dimension, or diameter less than d. To additionally facilitate insertion, each of the cavities 38, 38' may include a respective tapered entrance 50, 50'.

Means are provided for sealing the grounding arrangement from the ambient medium, particularly for underwater use. Such sealing means in the embodiment illustrated, includes an O-ring seal effected by means of an O-ring 54 which fits in a groove 55 surrounding the cavity 38.

Figure 4:
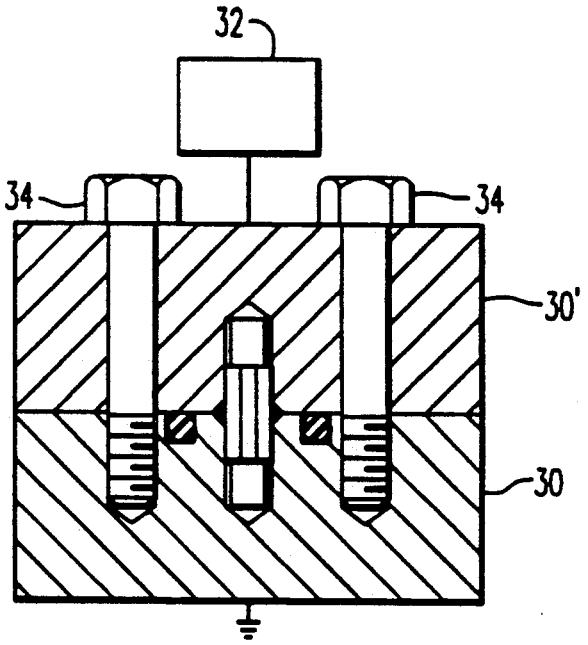
FIG. 4 is a cross-sectional view of an assembled connector.

When the device is ready for use, insert 40 is placed into one of the cavities, and the members 30, 30' are clamped together by means of the bolts 34, as illustrated in FIG. 4. In view of the fact that the insert 40 is of a slightly greater lateral diameter than the cavities 38, 38', and further in view of the fact that the insert is of relatively soft metal, the clamping together of members 30, 30' will cause the edges 43 to be shaved to obtain contact of bare metal on metal without the presence of any oxides which would increase contact resistance. In this regard, it is desirable to plate the cavities 38, 38', as well as the insert 40, with gold, by well-known plating techniques. Gold is a metal of choice for connectors since it is ductile, exhibits little oxidation, and is a good electrical conductor.

With the present invention therefore, each time a ground connection is to be broken and thereafter reestablished, the bolts may be removed, thereby separating the two members and the connection thereafter established utilizing a new soft metal rod with each reassembly of the apparatus. When the units are brought together, the harder material of the members 30, 30' scrapes away the copper rod to obtain contact of bare metal on metal without the presence of any oxides which may increase contact resistance, thereby providing for a very low impedance connection. The scraped-away metal may be accommodated in the tapered entrances 50, 50' or the members 30, 30' may be additionally machined to provide such volume as may be necessary.

We claim:

1. Low impedance electrical connection apparatus comprising:

a) first and second electrically conducting members, at least one of which is for electrical connection to electrical apparatus;

b) clamping means for releasably maintaining said members in intimate contact when in use;

c) each said member including a cavity which faces the cavity of the other member when said members are clamped together;

d) a metallic grounding insert for placement within one of said cavities and being of a softer material than said members;

e) said grounding insert and said cavities being constructed and arranged that when said grounding insert is inserted into said cavity and said members are clamped together, said grounding insert will align with both said cavities and a surface portion of said grounding device will be shaved as said conducting members are brought together, so as to make intimate electrical contact with and between said members.

2. Apparatus according to claim 1 which includes:

a) sealing means surrounding said chamber for excluding the surrounding ambient medium.

3. Apparatus according to claim 1 wherein:

a) said grounding insert is of a relatively soft metal of the group consisting of gold, beryllium copper and copper.

4. Apparatus according to claim 3 wherein:

a) said members are of a relatively hard metal of the group consisting of aluminum, stainless steel and titanium.

5. Apparatus according to claim 1 wherein:

a) said cavities are circular apertures;

b) said grounding insert is in the form of a multifaceted rod having end portions of a dimension to be inserted into either of said cavities and having a main body portion of a lateral dimension slightly greater than the diameter of said cavities, whereby the edges formed by adjacent facets are scraped to expose bare metal when said members are brought together.

6. Apparatus according to claim 5 wherein:

a) said circular cavities include tapered entrance portions to facilitate insertion of said rod and to accommodate scraped away metal from said rod when said members are brought together.

* * * * *